US005315731A

United States Patent [19]

Millar

[11] Patent Number: 5,315,731

[45] Date of Patent: May 31, 1994

[54] INDIVIDUAL TOOTH TOOTHBRUSH

[76] Inventor: George D. Millar, 2221 Cromwell Hills Dr., Cromwell, Conn. 06416

[21] Appl. No.: 831,455

[22] Filed: Feb. 5, 1992

[51] Int. Cl.[5] ..... A46B 9/04

[52] U.S. Cl. ..... 15/167.1; 15/DIG. 5

[58] Field of Search ..... 15/167.1, 167.2, DIG. 5

[56] References Cited

U.S. PATENT DOCUMENTS

| | | | |
|---|---|---|---|
| 1,059,426 | 4/1913 | Barnes | 15/167.1 |
| 1,133,930 | 3/1915 | Carroll | 15/167.2 |
| 1,382,681 | 6/1921 | Segal | 15/167.1 |
| 2,822,561 | 2/1958 | Rowley | 15/160 |
| 4,268,933 | 5/1981 | Papas | 15/167.1 |
| 4,672,706 | 6/1987 | Hill | 151/167.1 |
| 4,800,608 | 1/1989 | Key | 15/167.1 |

FOREIGN PATENT DOCUMENTS

| | | | |
|---|---|---|---|
| 0000723 | 2/1880 | United Kingdom | 15/167.1 |
| 0385238 | 12/1932 | United Kingdom | 15/167.1 |
| 1006669 | 10/1965 | United Kingdom | 15/167.1 |

*Primary Examiner*—Stephen F. Gerrity
*Assistant Examiner*—Randall E. Chin
*Attorney, Agent, or Firm*—David A. Testardi

[57] ABSTRACT

A toothbrush for cleaning individual teeth includes a longitudinally extending handle portion (10) connected to a curved head portion (20). The head portion (20) carries a plurality of relatively long, soft bristle tufts (31) arranged in transverse rows and a plurality of relatively short, hard bristle tufts (32) arranged in transverse rows sandwiched between the transverse rows of the plurality of relatively long, soft bristle tufts (31). The curved head portion (20) has a small radius of curvature of between 1.4 and 1.8 centimeters, optimally 1.5 centimeters, while the relatively long, soft bristle tufts (31) each extend radially from the curved head portion (20) by a distance of between 0.8 and 1.2 centimeters, optimally 1 centimeter. In this manner, the entire arrangement (30) of bristle tufts is made to converge substantially on the area of an individual tooth and its surrounding gum line.

20 Claims, 2 Drawing Sheets

INDIVIDUAL TOOTH TOOTHBRUSH

BACKGROUND OF THE INVENTION

1. Field of the Invention

This invention pertains to the field of toothbrushes. More particularly, this invention pertains to the field of toothbrushes having longitudinally curved or bent heads. Still more particularly, this invention pertains to the field of toothbrushes having longitudinally curved or bent heads which carry bristle tufts of bristles arranged for cleaning individual teeth.

2. Description of the Related Art

Various toothbrushes have been proposed which include longitudinally curved heads. Examples of these toothbrushes are shown in the following U.S. Patents, herein incorporated by reference: 4,712,267; 3,792,504; 2,722,504; 958,371; Des. 170,688; Des. 172,567; Des. 155,668; and Des. 113,744. However, in each of these toothbrushes, the degree of curvature of the toothbrush head has apparently been chosen so as to match the curvature of the rows of teeth within the human mouth. Consequently, these toothbrushes are not adapted to individually clean the various teeth within the human mouth; rather, they are adapted to clean the outer portions of rows of teeth, such as the incisors and the canine (or eye) teeth.

SUMMARY OF THE INVENTION

It is an object of the invention to provide a toothbrush designed to facilitate the cleaning of individual teeth.

It is another object of the invention to provide a toothbrush having bristles which are arranged to converge directly on a single tooth and its surrounding gum line, whereby a thorough and pleasant cleaning may be effected.

Specifically, the invention comprises a toothbrush having an elongated handle portion extending in a longitudinal direction, a head portion connected to the handle portion, the head portion having a first end and a second end, wherein the first end is spaced from the second end in the longitudinal direction, wherein a bent surface is provided on the head portion between the first end and the second end, and wherein the bent surface bends as it extends in the longitudinal direction, a first plurality of bristle tufts secured to the head portion and extending from the bent surface, the first plurality of bristle tufts being arranged in a first plurality of rows oriented transverse to the longitudinal direction, and a second plurality of bristle tufts secured to the head portion and extending from the bent surface, the second plurality of bristle tufts being arranged in a second plurality of rows oriented transverse to the longitudinal direction, wherein each of the first plurality of bristle tufts comprise relatively long bristles, and each of the second plurality of bristle tufts comprise relatively short bristles.

In another aspect, the invention comprises a toothbrush for cleaning individual teeth having an elongated handle portion extending in a longitudinal direction, a head portion connected to the handle portion, the head portion having a first end and a second end, wherein the first end is spaced from the second end in the longitudinal direction, wherein a concave surface is provided on the head portion between the first end and the second end, and wherein the concave surface bends as it extends in the longitudinal direction, a first plurality of bristle tufts secured to the head portion and extending from the concave surface, wherein the concave surface which defines part of a circular cylinder having a radius of curvature of between 1.4 and 1.8 centimeters, and wherein the first plurality of bristle tufts comprise bristles which extend between 0.8 and 1.2 centimeters from the concave surface substantially towards a center of curvature of the arc.

In yet another aspect, the invention comprises a toothbrush for cleaning individual teeth having an elongated handle portion extending in a longitudinal direction, a head portion connected to the handle portion, the head portion having a first end and a second end, wherein the first end is spaced from the second end in the longitudinal direction, wherein a bent surface is provided on the head portion between the first end and the second end, and wherein the bent surface bends as it extends in the longitudinal direction, a plurality of bristle tufts, each of the plurality of bristle tufts being secured to the head portion and extending from the bent surface in an outward direction to a free end, wherein at least a first one of the plurality of bristle tufts is secured to the head portion at a position near the first end, at least a second one of the plurality of bristle tufts is secured to the head portion at a position near the second end, and wherein an acute angle of between 60 and 100 degrees is formed between the outward direction of the first one of the plurality of bristle tufts and the outward direction of the second one of the plurality of bristle tufts.

The invention will, however, be best understood by a review of the following description in conjunction with the accompanying drawing figures, in which:

DETAILED DESCRIPTION OF THE PREFERRED EMBODIMENTS

Figure 1:
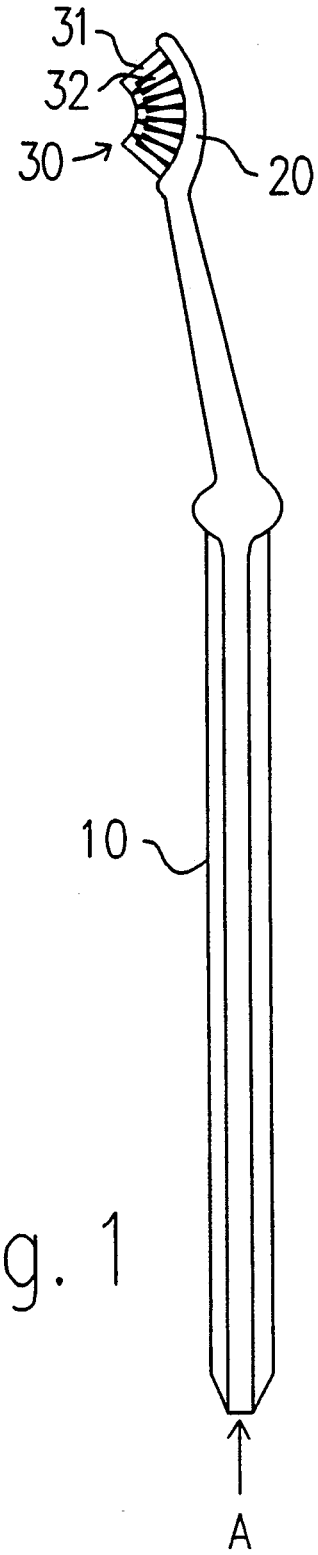
FIG. 1 is a side view of the individual tooth toothbrush according to the invention.

Referring first to FIG. 1, the toothbrush according to the present invention comprises a handle portion 10 connected to a curved or bent head portion 20. The handle portion 10 is elongated in a longitudinal direction of the toothbrush (defined by the arrow A) and is adapted to be grasped by the hand of a toothbrush user. The head portion 20 carries an arrangement of bristle tufts 30. The arrangement of bristle tufts comprises a first plurality of relatively long, soft bristle tufts 31, and a second plurality of relatively short, hard bristle tufts 32. The particular arrangement of the bristle tufts 31, 32 can best be understood by a description of FIG. 2.

Figure 2:
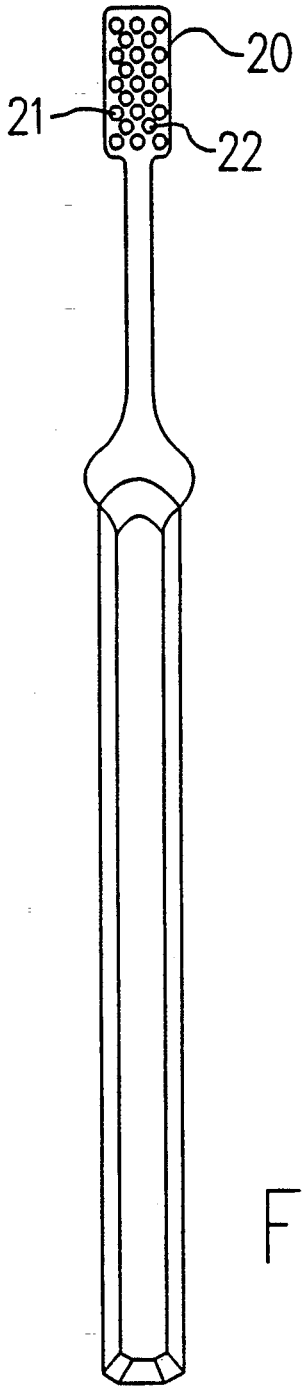
FIG. 2 is a modified frontal view of the toothbrush of FIG. 1, showing the head portion as though it were flattened and with the bristle tufts removed.
Figure 3:
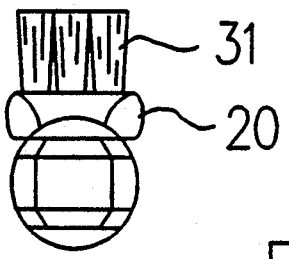
FIG. 3 is an end view of the toothbrush shown in FIG. 1.

In FIG. 2, the head portion 20 is shown as though flattened and with the bristle tufts 31, 32 removed in order to reveal the arrangement of recesses or blind openings within which the bottom ends of each one of the bristle tufts 31, 32 are adapted to be secured (in a conventional manner). A first plurality of recesses 21 are arranged in the head portion 20 in five rows of three, with each of the rows being oriented transverse to the longitudinal direction. The relatively long, soft bristle tufts 31 are, according to the invention, secured within each one of these first plurality of recesses 21. Consequently, the bristle tufts 31 are themselves oriented in the five transverse rows defined by the arrangement of the recesses 21. In FIG. 3, an end view of a tooth brush according to the invention is shown from which one of the transverse rows of three bristle tufts 31 is visible.

Referring again to FIG. 2, a second plurality of recesses 22 are arranged in the head portion 20 in four rows of two, with each of the rows being oriented transverse to the longitudinal direction. The relatively short, hard bristle tufts 32 are, according to the invention, secured within each one of these second plurality of recesses 22. Consequently, the bristle tufts 32 are themselves oriented in the four transverse rows defined by the arrangement of the recesses 22. Moreover, each row of the second plurality of recesses 22 is sandwiched between two of the rows of the first plurality of recesses 21. (As used herein, a "row" of elements is defined as a substantially linear arrangement of not less than two of the named elements or portions thereof.)

Figure 4:
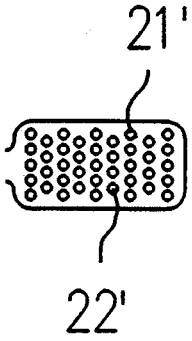
FIG. 4 shows a modification of the head portion of the toothbrush shown in FIG. 2.

While the toothbrush in FIG. 1 carries fifteen long, soft bristle tufts 31 and eight short, hard bristle tufts 32, as arranged in the described transverse rows, other numbers of bristle tufts could be secured to the head portion 20. For example, in FIG. 4, a modified version of the head portion is shown having a first plurality of recesses 21,, arranged in five rows of four, within which the long, soft bristle tufts are adapted to be disposed, and a second plurality of recesses 22', arranged in four rows of three, within which the short, hard bristle tufts are adapted to be disposed.

Figure 5:
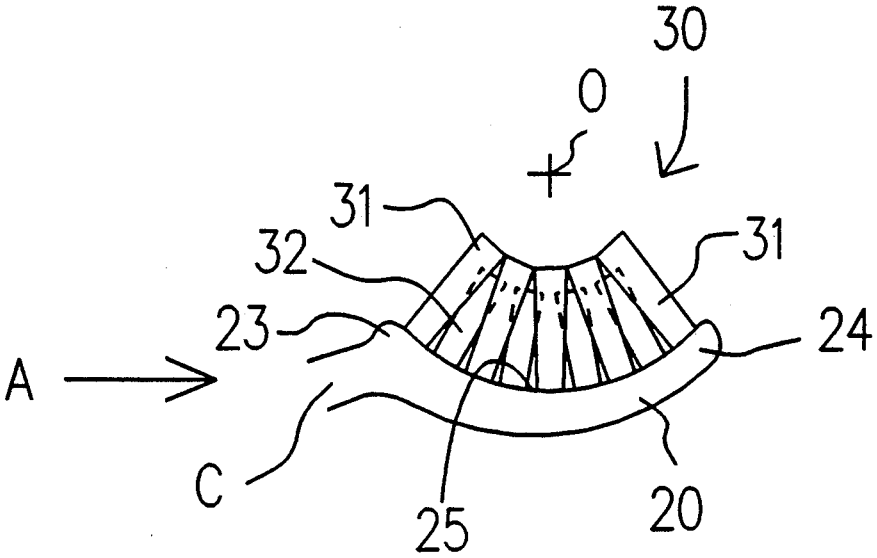
FIG. 5 is an enlarged side view of the head portion of the toothbrush shown in FIG. 1.

Referring now to FIG. 5, an enlarged side view of the head portion 20 is shown. The head portion 20 comprises two ends 23, 24. The end 23 is integrally formed with and connected to the handle portion 10 at a connecting zone C. The end 24 constitutes a free end. The end 24 is spaced from the end 23 in the longitudinal direction A. A curved or bent surface 25 is provided on the head portion 20 between the two ends 23, 24. According to the invention, the curved or bent surface 25 is concave or concave-like and bends as it extends in the longitudinal direction. In the preferred embodiment shown in FIG. 5, the entire head portion 20 is curved in such a manner that the surface 25 defines part of a circular, cylinder having a center of curvature, or axis, designated as O. The axis of the part of the circular cylinder extends orthogonally to the longitudinal direction. However, it is envisioned that other surface configurations could be employed in place of such a partial circular cylindrical surface.

As shown in FIG. 5, each of the bristle tufts 31, 32 extends from the curved surface 25 towards the center of curvature O in a generally radial direction. According to the invention, a radius of curvature of the partial cylindrical surface 25 is between approximately 1.4 and 1.8 centimeters, preferably between approximately 1.4 and 1.6 centimeters, and optimally substantially 1.5 centimeters. This small radius of curvature is in contradistinction to the relatively large radii of curvature provided in the prior art toothbrushes noted above. Moreover, as seen in FIGS. 1 and 5, an angle formed between a direction of the bristles of the long, soft bristle tuft 31 nearest to the end 23 of the head portion and a direction of the bristles of the long, soft bristle tuft 31 nearest to the end 24 is between about 60 and 100 degrees, and preferably between e.g. 75 and 90 degrees. This relatively large angle formed (or subtended) by the directions (of extension) of the bristle tufts 31 at opposite ends of the head portion 20 is also in contradistinction to the relatively small angles shown in the prior art toothbrushes noted above. Still furthermore, a distance between the free end of the long, soft bristle tuft 31 nearest to the end 23 and the free end of the long, soft bristle tuft 31 nearest to the end 24 is preferably not more than approximately 1.2 centimeters in the longitudinal direction, and optimally not more than approximately 1 centimeter. This too is in contradistinction to the relatively long longitudinal distances between the free ends of the longitudinally opposite bristle tufts in the prior art toothbrushes noted above.

The first plurality of bristle tufts 31 each comprise bristles which extend between approximately 0.8 and 1.2 centimeters from the curved surface 25. Preferably, the bristles of the first plurality of bristle tufts 31 extend between approximately 0.9 and 1.1 centimeters, and optimally they extend substantially 1 centimeter. Moreover, it is preferred that all of the bristles in all of the first plurality of bristle tufts 31 extend an equal distance from the curved surface.

The second plurality of bristle tufts 32 each comprise bristles which are shorter than the bristles of the first plurality of bristle tufts by a length of between 0.1 and 0.3 centimeters. Consequently these bristles may extend between e.g. 0.6 and 0.9 centimeters from the curved surface 25. Moreover, it is preferred that all of the bristles in all of the second plurality of bristle tufts 32 extend an equal distance from the curved surface.

While in the previously described embodiments it has been contemplated to provide an individual tooth toothbrush wherein the first plurality of bristle tufts 3 comprise relatively soft bristles and the second plurality of bristle tufts 32 comprise relatively hard bristles, it is equally contemplated that both the first plurality of bristle tufts 31 comprising the relatively long bristles and the second plurality of bristle tufts 32 comprising the relatively short bristles may be provided so as to comprise the relatively soft bristles. Moreover, although the arrangement of bristle tufts 30 may be secured to the bent head portion 20 directly, it is equally envisioned that the arrangement of bristle tufts 30 may be secured to a flat head portion made from a suitable heatmoldable plastic, and thereafter the flat head portion may be heated to a suitable molding temperature and plastically deformed into the desired bent shape. (By way of example, and not by way of limitation, the heat-moldable plastic may comprise tenite propionate, available from Eastman Plastics in F.D.A. approved grades Basic 350 or 351, the specific gravity of which is approximately 1.18 and the molding temperature for which is approximately 300 degrees F.)

As mentioned above, the present invention provides for a thorough and pleasant cleaning of individual teeth and of the gum lines surrounding the individual teeth. Since the bristle tufts are arranged to converge on a single tooth, it is possible for all of the bristle tufts to contact the various surfaces of the individual tooth at substantially the same time, whereby the intensive cleaning of individual teeth is improved. Moreover, since some of the bristle tufts are longer than others, it is possible for the ends of longer bristle tufts to clean and massage the surrounding gum lines as well, whereby the possibility of gum diseases can be mitigated. Accordingly, the entire tooth-brushing experience is made more effective and gratifying by use of the individual tooth toothbrush according to the present invention.

While the present invention has been described with certain particularity, it is not meant to be limited to the above disclosed embodiments. Therefore, the present invention will encompass the above disclosed embodiments and any modifications thereof which will fall within the scope of the appended claims.

I claim:

1. A toothbrush comprising:

an elongated handle portion extending in a longitudinal direction;

a head portion connected to the handle portion, the head portion having a first end and a second end, wherein the second end is spaced from the first end in the longitudinal direction, wherein a bent surface is provided on the head portion between the first end and the second end, and wherein the bent surface bends as it extends in the longitudinal direction;

a fist plurality of bristle tufts secured to the head portion and extending from the bent surface, the first plurality o bristle tufts being arranged in a first plurality of rows oriented transverse to the longitudinal direction; and a second plurality of bristle tufts secured to the head portion and extending from the bent surface, the second plurality of bristle tufts being arranged in a second plurality of rows oriented transverse to the longitudinal direction, wherein each of the first plurality of bristle tufts comprise relatively long bristles, and each of the second plurality of bristle tufts comprise relatively short bristles, and wherein all of the bristles of the first plurality of bristle tufts extend substantially an equal distance from the bent surface, and wherein all of the bristles of the second plurality of bristle tufts extend substantially an equal distance from the bent surface.

2. A toothbrush as recited in claim 1, wherein the bent surface is a concave surface which defines part of a circular cylinder having a radius of curvature of between 1.4 and 1.8 centimeters, and wherein the bristles of the first plurality of bristle tufts extend between 0.8 and 1.2 centimeters from the concave surface substantially towards a center of curvature of the concave surface.

3. A toothbrush as recited in claim 2, wherein the concave surface has a radius of curvature of between 1.4 and 1.6 centimeters, and wherein the bristles of the first plurality of bristle tufts extend between 0.9 and 1.1 centimeters from the concave surface substantially towards the center of curvature of the concave surface.

4. A toothbrush as recited in claim 3, wherein the concave surface has a radius of curvature of substantially 1.5 centimeters and wherein the bristles of first plurality of bristle tufts extend substantially 1.0 centimeter from the concave surface substantially towards the center of curvature of the concave surface.

5. A toothbrush as recited in claim 4, wherein the bristles of the second plurality of bristle tufts extend between 0.6 and 0.9 centimeters from the concave surface.

6. A toothbrush as recited in claim 5, wherein the bristles of the first plurality of bristle tufts subtend a maximum angle at the center of curvature of between 60 and 100 degrees.

7. A toothbrush as recited in claim 5, wherein each of the first plurality of rows comprises at least three of the first plurality of bristle tufts which are arranged side by side with one another, and wherein each of the second plurality of rows comprises at least two of the second plurality of bristle tufts which arranged side by side with one another.

8. A toothbrush as recited in claim 5, wherein each one of the second plurality of rows of bristle tufts is sandwiched between two of the first plurality of rows of bristle tufts, and wherein the bristles of the first plurality of bristle tufts are relatively soft bristles, and the bristles of the second plurality of bristle tufts are relative hard bristles.

9. A toothbrush for cleaning individual teeth, comprising:

an elongated handle portion extending in a longitudinal direction;

a head portion connected to the handle portion, the head portion having a first end and a second end, wherein the first end is spaced from the second end in the longitudinal direction, wherein a concave surface is provided on the head portion between the first end and the second end, and wherein the concave surface bends as it extends in the longitudinal direction;

a first plurality of bristle tufts secured to the head portion and extending from the concave surface;

a second plurality f bristle tufts secured to the head portion and extending from the concave surface;

wherein the concave surface defines part of a circular cylinder having a radius of curvature of between 1.4 and 1.8 centimeters, wherein the first plurality of bristle tufts comprise bristles which extend between 0.8 and 1.2 centimeters from the concave surface substantially towards a center of curvature of the concave surface, and wherein the second plurality of bristle tufts comprise bristles which extend from the concave surface substantially towards the center of curvature of the concave surface.

10. A toothbrush as recited in claim 9, wherein the concave surface has a radius of curvature of between approximately 1.4 and 1.6 centimeters, wherein the bristles of the first plurality of bristle tufts extend between 0.9 and 1.1 centimeters from the concave surface substantially towards the center of curvature of the concave surface, and wherein all of the bristles of the first plurality of bristle tufts extend substantially an equal distance from the concave surface.

11. A toothbrush as recited in claim 10, wherein the concave surface has a radius of curvature of substantially 1.5 centimeters, wherein the bristles of first plurality of bristle tufts extend substantially 1.0 centimeter from the concave surface substantially towards the center of curvature of the concave surface, and wherein an axis of the part of the circular cylinder extends orthogonally to the longitudinal direction.

12. A toothbrush as recited in claim 10, wherein the bristles of the first plurality of bristle tufts subtend a maximum angle at the center of curvature of between 60 and 100 degrees.

13. A toothbrush as recited in claim 10, wherein the second plurality of bristle tufts comprise bristles which are relatively shorter than the bristles of the first plurality of bristle tufts.

14. A toothbrush as recited in claim 13, wherein the bristles of the second plurality of bristle tufts are between 0.1 and 0.4 centimeters shorter than the bristles of the first plurality of bristle tufts.

15. A toothbrush as recited in claim 13, wherein the first plurality of bristle tufts are arranged in a first plurality of rows oriented transverse to the longitudinal direction, and the second plurality of bristle tufts are arranged in a second plurality of rows oriented transverse to the longitudinal direction.

16. A toothbrush as recited in claim 15, wherein each of the first plurality of rows comprises at least three of the first plurality of bristle tufts which are arranged side by side with one another, and wherein each of the second plurality of rows comprises at least two of the second plurality of bristle tufts which arranged side by side with one another.

17. A toothbrush as recited in claim 16, wherein each one of the second plurality of rows of bristle tufts is sandwiched between two of the first plurality of rows of bristle tufts, and wherein the bristles of the first plurality of bristle tufts are relatively soft bristles, and the bristles of the second plurality of bristle tufts are relatively hard bristles.

18. A toothbrush as recited in claim 13, wherein all of the bristles of the second plurality of bristle tufts extend substantially an equal distance from the concave surface.

19. A toothbrush for cleaning individual teeth, comprising:

an elongated handle portion extending in a longitudinal direction;

a head portion connected to the handle portion, the head portion having a first end and a second end, wherein the first end is spaced from the second end in the longitudinal direction, wherein a bent surface is provided on the head portion between the first end and the second end, and wherein the bent surface bends as it extends in the longitudinal direction; and a plurality of bristle tufts, each of the plurality of bristle tufts being secured to the head portion and extending in a direction from the bent surface to a free end;

wherein at least a first one of the plurality of bristle tufts is secured to the head portion at a portion near the first end, at least a second one of the plurality of bristle tufts is secured to the head portion at a position near the second end, wherein an angle of between 60 and 100 degrees is formed between the direction of the first one of the plurality of bristle tufts and the direction of the second one of the plurality of bristle tufts, and wherein the free end of the first one of the plurality of bristle tufts is spaced from the free end of the second one of the plurality of bristle tufts by a distance not more than about 1.2 centimeters in the longitudinal direction, whereby the plurality of bristle tufts are made to converge substantially on the area of an individual tooth and its surrounding gum line.

20. A toothbrush as recited in claim 19, wherein the angle is between approximately 75 and approximately 90 degrees, and wherein the free end of the first one of the plurality of bristle tufts is spaced from the free end of the second one of the plurality of bristle tufts by a distance not more than approximately 1 centimeter in the longitudinal direction.

* * * * *